US009792887B2

(12) United States Patent
Pinelli

(10) Patent No.: US 9,792,887 B2
(45) Date of Patent: Oct. 17, 2017

(54) ACOUSTIC DRUM KIT, AND ENSEMBLE OF MUSICAL INSTRUMENTS COMPRISING SUCH AN ACOUSTIC DRUM KIT

(71) Applicant: Savarez, Caluire et Cuire (FR)

(72) Inventor: Dario Pinelli, Manduria (IT)

(73) Assignee: Savarez, Caluire et Cuire (FR)

( * ) Notice: Subject to any disclaimer, the term of this patent is extended or adjusted under 35 U.S.C. 154(b) by 0 days.

(21) Appl. No.: 15/271,276

(22) PCT Filed: Mar. 13, 2015

(86) PCT No.: PCT/EP2015/055330
§ 371 (c)(1),
(2) Date: Sep. 21, 2016

(87) PCT Pub. No.: WO2015/144461
PCT Pub. Date: Oct. 1, 2015

(65) Prior Publication Data
US 2017/0169803 A1 Jun. 15, 2017

(30) Foreign Application Priority Data
Mar. 27, 2014 (IT) ..... TA2014U0003

(51) Int. Cl.
*G10D 13/00* (2006.01)
*G10D 13/02* (2006.01)
*G10D 13/06* (2006.01)

(52) U.S. Cl.
CPC ..... *G10D 13/00* (2013.01); *G10D 13/025* (2013.01); *G10D 13/065* (2013.01)

(58) Field of Classification Search
CPC ..... G10D 13/025; G10D 13/065
See application file for complete search history.

(56) References Cited

U.S. PATENT DOCUMENTS 3,326,074 A * 6/1967 Osty ..... G10D 13/029 84/411 R
6,211,448 B1 4/2001 Shigenaga et al.
2010/0043622 A1 2/2010 Sandson
2011/0113948 A1* 5/2011 Izen ..... G10D 13/026 84/411 R

FOREIGN PATENT DOCUMENTS

CA 2529308 A1 6/2007
GB 645070 A 10/1950
WO 2010060167 A2 6/2010

OTHER PUBLICATIONS

Reetz, "Build-a-Suitcase-Drum-Set", Dec. 10, 2010, 14 pages. http://www.mikereetz.com/documents/Build-a-Suitcase-Drum-Set.pdf.
PCT/EP2015/055330, Rapport de Recherche Internationale, Jun. 8, 2015, 3 pages.

* cited by examiner

*Primary Examiner* — Kimberly Lockett
(74) *Attorney, Agent, or Firm* — Soquel Group LLC

(57) ABSTRACT

An acoustic drum kit including a bass drum, a snare drum and a hi-hat stand, the base drum including two parts that are movable with respect to one another between a spaced-apart position, in which the snare drum is fixed removably to the bass drum and to the hi-hat stand such that the drum kit is in a playing configuration, and a compact position, in which the snare drum and the hi-hat stand are housed inside the bass drum, between the two parts thereof, such that the drum kit is in a storage and transport configuration.

15 Claims, 9 Drawing Sheets

ACOUSTIC DRUM KIT, AND ENSEMBLE OF MUSICAL INSTRUMENTS COMPRISING SUCH AN ACOUSTIC DRUM KIT

CROSS REFERENCE TO RELATED APPLICATIONS

This application claims benefit under 35 USC §371 of PCT Application No. PCT/EP2015/055330 entitled ACOUSTIC DRUM KIT, AND ENSEMBLE OF MUSICAL INSTRUMENTS COMPRISING SUCH AN ACOUSTIC DRUM KIT, filed on Mar. 13, 2015 by inventor Dario Pinelli. PCT Application No. PCT/EP2015/055330 claims priority of Italian Patent Application No. TA2014U000003 entitled ACOUSTIC DRUM KIT, AND ENSEMBLE OF MUSICAL INSTRUMENTS COMPRISING SUCH AN ACOUSTIC DRUM KIT and filed on Mar. 27, 2014 by inventor Dario Pinelli.

FIELD OF THE INVENTION

The present invention relates to an acoustic drum kit, as well as an ensemble of musical instruments comprising such an acoustic drum kit.

The invention relates to the field of musical instruments, more particularly percussion instruments, for both professional and recreational use.

BACKGROUND OF THE INVENTION

In this field, it is known that an acoustic drum kit is an ensemble of percussion instruments which, in a typical form, includes, or even consists of, a bass drum, a snare drum and a high hat, i.e., a pair of cymbals attached to a foot pedal. Such a drum kit is, due to the cumulative bulk of the instruments making it up, difficult to store and even more difficult to transport, with a significant transport cost when the drummer travels by plane and wishes to take his drum kit with him.

To overcome this issue, electronic drums kits exist, comprising flat pancake-shaped panels, commonly called "pads", that more or less reproduce the feel of an acoustic drum kit, but without producing the volume thereof, the vibrations caused by striking these panels having to be amplified by ad hoc electronic devices. Once stored, these panels take up less space than the instruments making up an acoustic drum kit, such that the electronic drum kit is easier to transport. The price of such an electronic drum kit is high, however, and above all, electronic drum kits do not produce the same sound effects or the same sensations as playing an acoustic drum kit.

SUMMARY OF THE DESCRIPTION

The aim of the present invention is to propose an acoustic drum kit that is easy and practical to store and transport, while producing high quality sound.

To that end, the invention relates to an acoustic drum kit, including a bass drum, including two parts that are movable with respect to one another between a spaced-apart position and a compact position, and attachments, a snare drum having a globally parallelepiped outer shape, including first and second attachments, the second attachments being separate from the first attachments, and a hi-hat stand, including a base having a globally parallelepiped outer shape, the base including attachments, wherein when the two parts of the bass are in the spaced-apart position, the two parts of the bass drum jointly give the bass drum a globally parallelepiped outer shape and jointly define between them a free bass drum resonance volume that is substantially parallelepiped, and the snare drum is removably fastened to the base drum and to the base of the hi-hat stand such that the acoustic drum kit is in a playing configuration, wherein when the two parts of the bass drum are in the compact position, the two parts of the bass drum jointly give the bass drum a globally parallelepiped outer shape and jointly define between them a housing volume which is substantially parallelepiped, which is smaller than the bass drum resonance volume, and which is occupied by the hi-hat stand and the snare drum that is housed inside the base of the hi-hat stand, such that the acoustic drum kit is in a storage and transport configuration, wherein the attachments of the bass drum and the first attachments of the snare drum removably fasten the snare drum on the bass drum in the playing configuration of the acoustic drum kit, and wherein the attachments of the base of the hi-hat stand and the second attachments of the snare drum removably fasten the snare drum on the base of the hi-hat stand in the playing configuration of the acoustic drum kit.

One of the ideas at the base of the invention is to use a bass drum wisely as a housing for a snare drum and a hi-hat stand when one wishes to store and transport the corresponding acoustic drum kit. To that end, the bass drum comprises two parts that can be moved relative to one another. In a spaced-apart position of these two parts of the bass drum, the latter can be used as a percussion instrument, while being empty inside to define a bass drum resonance volume therein, and it serves as a removable fastening support for the snare drum, the latter also being fastened removably to the hi-hat stand: the bass drum, the snare drum and the hi-hat stand are then in a playing configuration, while being arranged relative to one another similarly to an acoustic drum kit of the prior art. To be able to play the drum kit according to the invention, in the playing configuration, the drummer associates it with a pair of cymbals and a bass drum pedal, which are known as such, for example being commercially available, and that must respectively be attached on the hi-hat stand and the bass drum, the drummer using a pair of drum sticks or brushes to play, as is known in itself and commercially available. In a first compact position of the two parts of the bass drum, the snare drum and the hi-hat stand are arranged inside the bass drum, while being housed between the two parts of said bass drum, the drum kit then being in the storage and transport configuration, taking up a particularly small total volume. In particular, the drum kit according to the invention, in its storage and transport configuration, advantageously complies with the common dimensional requirements for carry-on luggage allowed by well-known airlines, while also complying with the associated weight requirements: thus, owing to the invention, a drummer can travel by plane while keeping the drum kit according to the invention with him as carry-on luggage. In practice, the transition of the drum kit according to the invention between the playing configuration and the storage and transport configuration is done easily and in a very short amount of time, i.e., several tens of seconds.

The invention also relates to an ensemble of musical instruments, including an acoustic drum kit as defined above, a bass drum pedal, a pair of hi-hat cymbals, and a pair of drumsticks or brushes.

Additional advantageous features of the acoustic drum kit and ensemble of musical instruments according to the invention are given in the description below.

BRIEF DESCRIPTION OF THE DRAWINGS

The invention will be better understood upon reading the following description, provided solely as an example and done in reference to the drawings, in which.

DETAILED DESCRIPTION

FIGS. 1-11 show an acoustic drum kit 1 comprising three main components, namely a bass drum 10, a snare drum 20 and a hi-hat stand 30. Hereinafter, these components will successively be described in detail.

Figure 1:
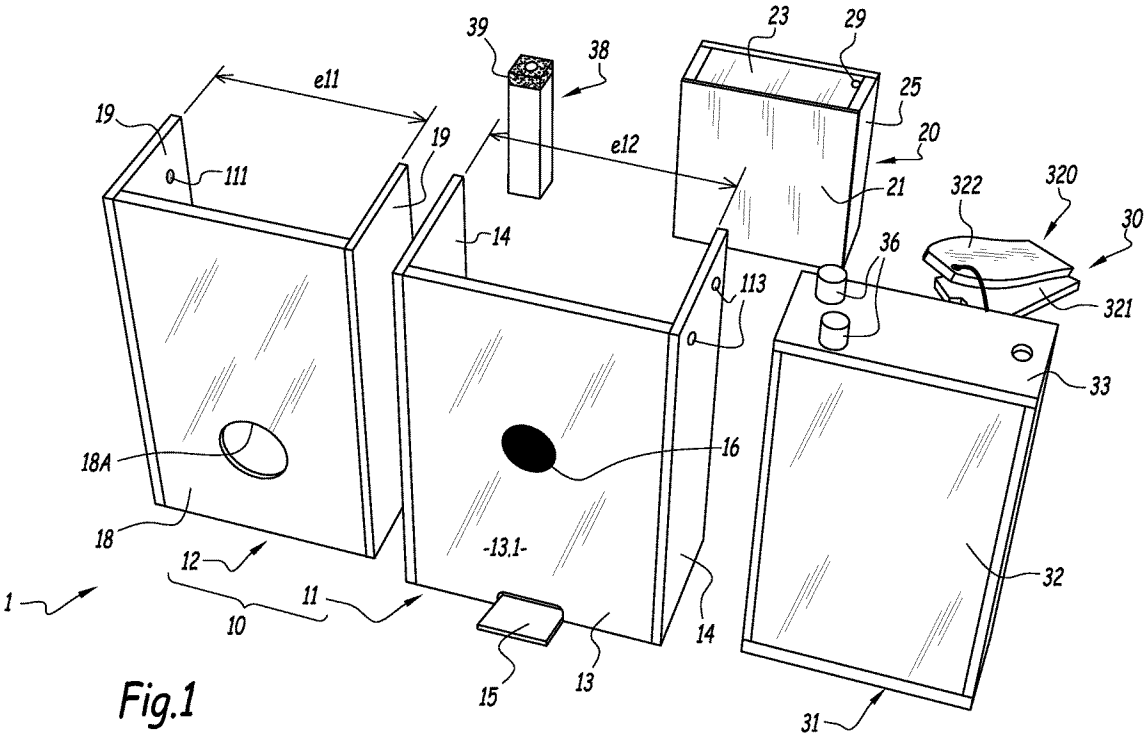
FIGS. 1 and 2 are perspective views, from different respective viewing angles, of the components, separated from one another, of an acoustic drum kit according to the invention.
Figure 2:
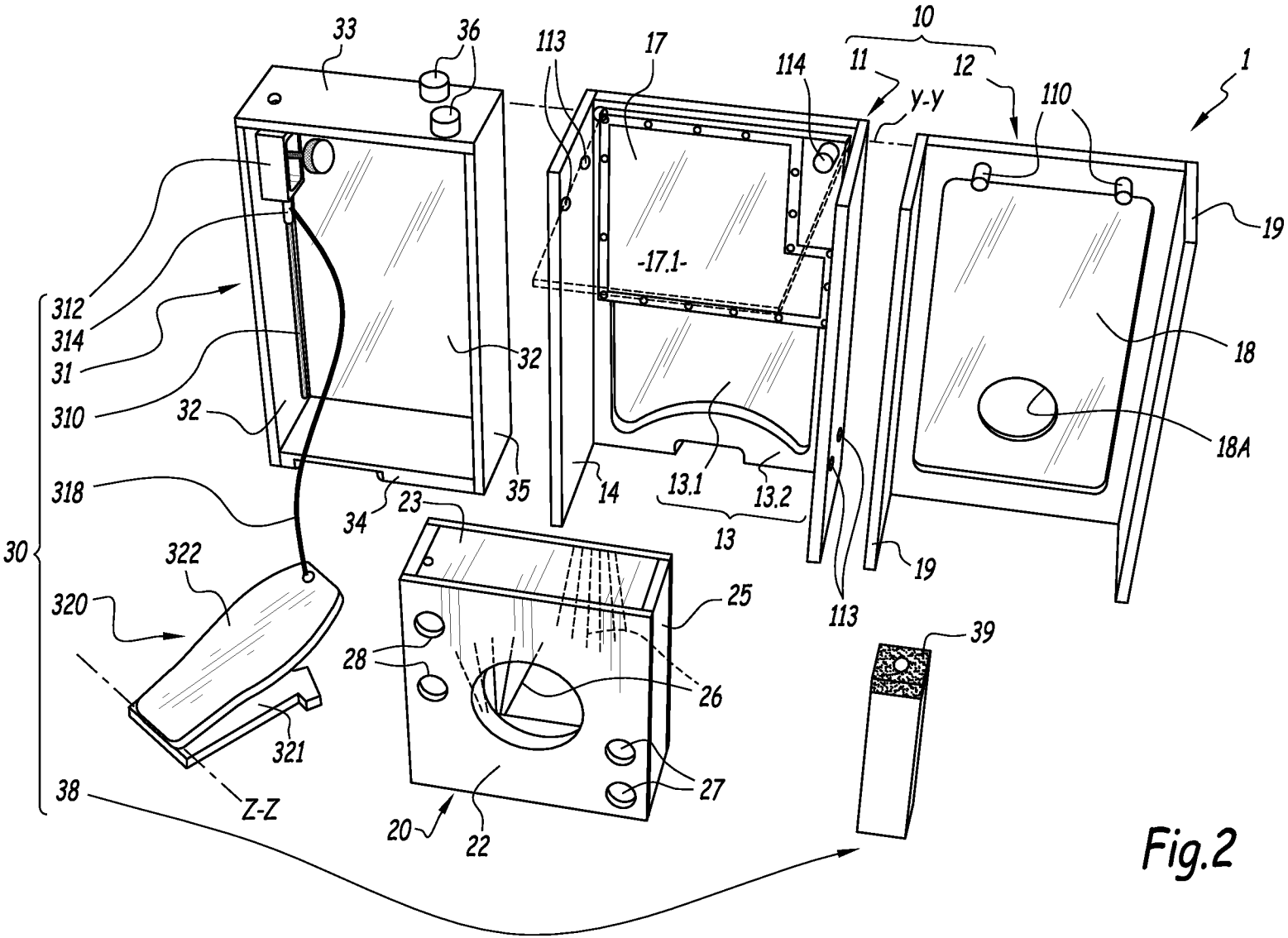
Figure 10:
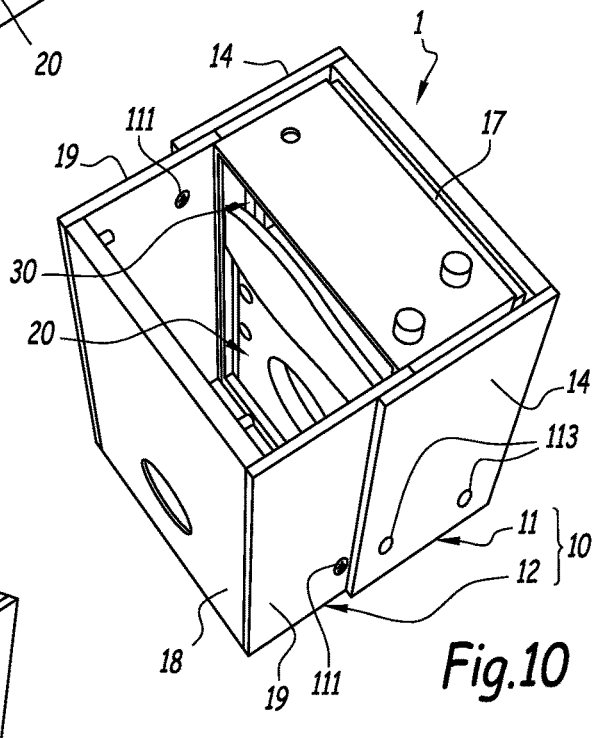
Figure 11:
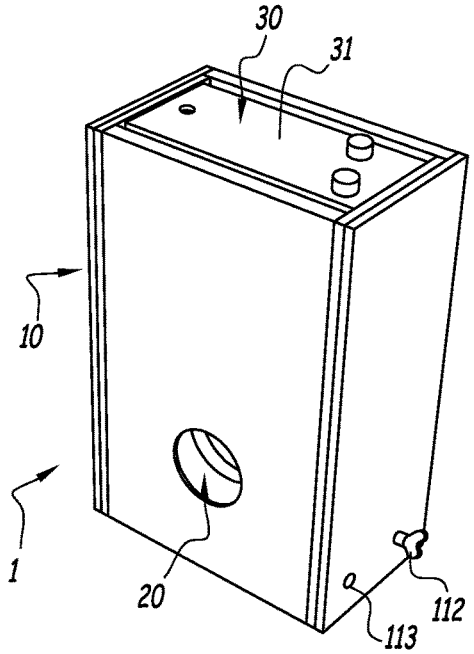

In FIGS. 3-7, the bass drum 10, the snare drum 20 and the hi-hat stand 30 are assembled such that the drum kit 1 is in a playing configuration, i.e., a configuration in which the user of the drum kit, in other words a drummer, can play the drum kit 1 in the same way as with an acoustic drum kit of the prior art. In FIG. 11, the bass drum 10, the snare drum 20 and the hi-hat stand 30 are arranged relative to one another such that the drum kit 1 is in a storage and transport configuration, the drum kit 1 going from its playing configuration of FIGS. 3-7 to its storage and transport configuration of FIG. 11, through the intermediate progressive storage configurations, shown in FIGS. 8-10. In FIGS. 1 and 2, the snare drum 20, the components of the bass drum 10, provided to be disassembled by the user, and the components of the hi-hat stand, provided to be disassembled by the user, are shown separately from one another.

For convenience, the rest of the description is oriented relative to the player of the drum kit 1 when the latter is in the playing configuration and resting on a floor considered to be horizontal.

The bass drum 10 includes two main parts, i.e., a front part 11 and a rear part 12, that each substantially corresponds to half of the bass drum 10. The parts 11 and 12 of the bass drum 10 are made in the form of two separate pieces, which are movable relative to one another, or even separable from one another for practical reasons, as shown in FIGS. 1 and 2.

As clearly shown in FIGS. 1 and 2, the front part 11 comprises a front main panel 13 and two side panels 14, left and right, respectively. Each of the panels 13 and 14 is substantially planar. The panels 13 and 14 are fixedly permanently secured to one another, using any appropriate means.

The side panels 14 extend toward the rear from the opposite side edges of the front panel 13, substantially perpendicular to the front panel 13. In sectional view in a horizontal plane, the front panel 13 and the side panels 14 jointly have a U-shaped profile turned toward the rear.

The panels 13 and 14 have a same vertical dimension, their upper edge being flush with one of the others and their lower edge also being flush with one of the others.

In the playing configuration of the drum kit 1, the respective lower edges of the panels 13 and 14 of the front part 11 bear on the floor, stably and autonomously for the front part 11 of the bass drum 10, due to the aforementioned U-shaped profile. The front panel 13 is provided, on its lower edge, with an attachment member 15 for a bass drum pedal, not shown in the figures, provided to be controlled by the drummer's right foot. This panel must be attached to the bass drum 10 to allow the drummer to strike the front face of the panel 13 using an ad hoc hammer of the pedal. Such a bass drum pedal is known in itself and commercially available as an accessory for the acoustic drum kits of the prior art. As a non-limiting example, the attachment member 15 consists of a plate provided with a nonslip coating, for example rubber or the like, guaranteeing good retention of the bass drum pedal: in the playing configuration of the drum kit 1, this plate protrudes toward the front of the lower edge of the panel 13, this plate advantageously being retractable, at least in part, toward the rear, in particular into the thickness of the panel 13, in the storage and transport configuration of the drum kit 1.

Figure 4:
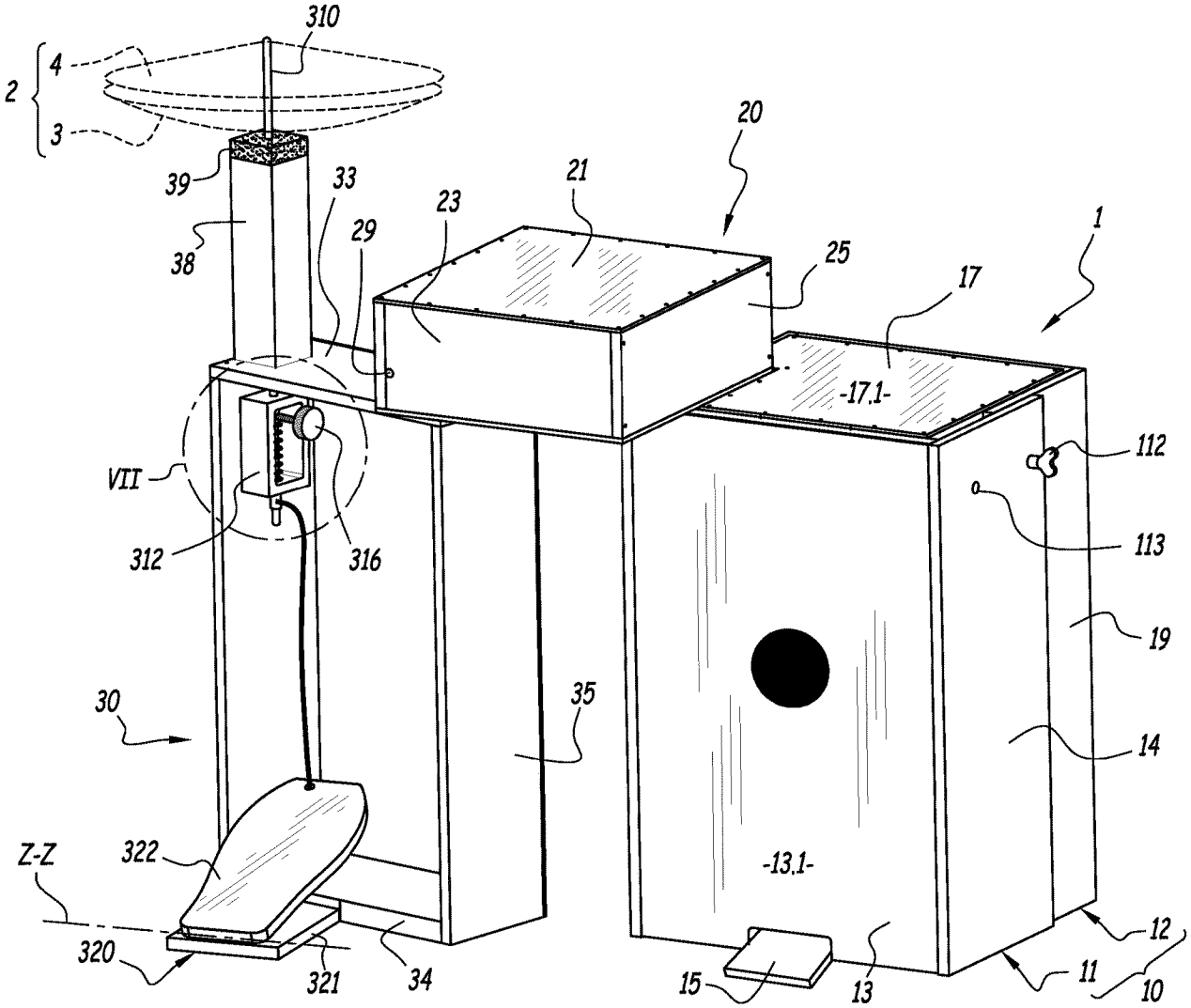

As clearly shown in FIGS. 1 and 4, the front face of the panel 13 is provided with felt 16 or the like, arranged such that the hammer of the bass drum pedal strikes the panel 13 at that felt, thus damping the sound attack and darkening the resulting sound. The felt 16 also provides a visual indication of the zone of the panel 13 provided to be struck by the hammer of the bass drum pedal.

As clearly shown in FIG. 2, the front panel 13 is provided, on its rear face, with a moving panel 17, which is substantially planar and which is brought to the upper end of the panel 13 so as to tilt around a horizontal geometric axis Y-Y. The interest of this tilting panel 17 will appear later.

As clearly shown in FIGS. 1 and 2, the rear part 12 of the bass drum 10 includes a rear main panel 18 and two side panels 19, left and right, respectively. Each of the panels 18 and 19 is substantially planar. The panels 18 and 19 are fixedly permanently secured to one another, using any appropriate means.

The side panels 19 extend toward the front from the opposite side edges of the rear panel 18, respectively, perpendicular to the latter. Thus, in horizontal sectional view, the panels 18 and 19 jointly give the rear part 12 of the bass drum 10 a U-shaped profile turned toward the front. The horizontal separation, denoted e12 in FIG. 1, between the respective faces of the side panels 19, turned opposite the rear panel 18, is provided to be equal to or slightly smaller than the horizontal separation, denoted e11 in FIG. 1, between the respective faces of the side panels 14 of the front part 11, turned toward the front panel 13: thus, as shown in FIGS. 10 and 11, the rear part 12 forms a male part, sized to be nested in the front part 11, which thus forms a complementary female part, this nesting between the parts 11 and 12 consisting of arranging the panels 19 between the panels 14 in an adjusted manner.

The panels 18 and 19 of the rear part 12 have a same vertical dimension, which is substantially equal to that of the panel 13 and 14 of the front part 11. The respective upper edges of the panels 18 and 19 are flush with one another. Likewise, the respective lower edges of the panels 18 and 19 are flush with one another, these lower edges bearing on the floor in the playing configuration of the drum kit 1, stably and autonomously for the rear part 12 due to its U-shaped profile.

The rear panel 18 defines a through opening 18A, thus connecting the front and rear faces of the panel 18 to one another.

As clearly shown in FIG. 2, the front face of the rear panel 18 is provided, at its upper end, with two protruding lugs 110 or, more generally, with at least one protruding relief, the interest of which will appear later.

The front 11 and rear 12 parts of the bass drum 10 are designed so as, subject to their relative movement, to be fixedly assembled to one another in two different positions, i.e., a separated position, which is shown in FIGS. 1 to 6 and which is associated with the playing configuration of the drum kit 1, and a compact position, which is shown in FIG. 11 and which is associated with the storage and transport configuration of the drum kit. When the front 11 and rear 12 parts of the bass drum 10 are in the spaced-apart position, the rear part 12 is only partially nested in the front part 11, inasmuch as only the respective free end parts of the panels 19 of the rear part 12 are arranged between the panel 14 of the front part 11, as clearly shown in FIGS. 4-6, whereas when the front 11 and rear 12 parts of the bass drum 10 are in the compact position, the rear part 12 is completely nested in the front part 11, in that a larger part of the panels 19 is arranged between the panels 14 than in the spaced-apart position, or all of the panels 19 as well as the panel 18 are arranged between the panels 14, as shown in FIG. 11.

Figure 3:
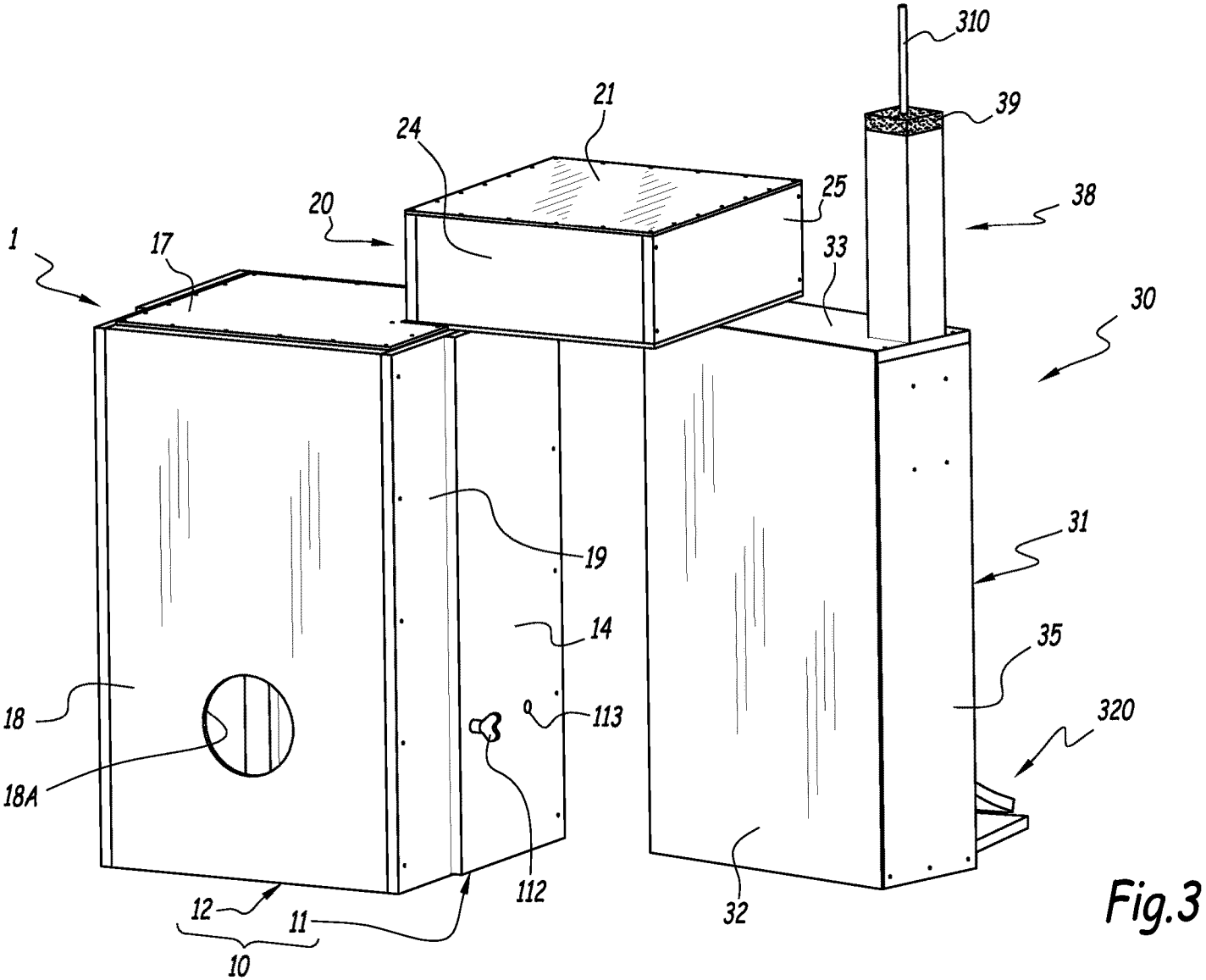
FIGS. 3-6 are perspective views, from different respective viewing angles, of the drum kit of FIG. 1 in a playing configuration.

In both positions, i.e., in the spaced-apart position and in the compact position, the upper edges of the panels 13 and 14 of the front part 11 are flush with the upper edges of the panels 18 and 19 of the rear part 12, and the lower edges of the panels 13 and 14 are flush with the lower edges of the panels 18 and 19: thus, in the two relative positions of the parts 11 and 12 of the bass drum 10, these parts 11 and 12 jointly give the bass drum 10 a globally parallelepiped outer shape, the lateral horizontal dimension of the parallelepiped shape associated with the first spaced-apart position being strictly larger than that of the parallelepiped shape associated with the compact position, as clearly shown by comparison between FIGS. 3 and 11. According to a preferred dimensioning, this parallelepiped outer shape measures 30 cm×45 cm×18 cm when the parts 11 and 12 are in the compact position, which complies with the common dimensional requirements for carry-on luggage by major airlines.

Furthermore, in both the spaced-apart position and the compact position of the parts 11 and 12 of the bass drum 10, the panels 13, 14, 18 and 19 of these parts 11 and 12 jointly define a substantially parallelepiped inner volume between them, the inner volume associated with the spaced-apart position being larger than that associated with the compact position. As explained below, this inner volume is provided so as, in the compact position of the parts 11 and 12 of the bass drum 10, to be occupied, in large part or almost in full, by the snare drum 20 and the hi-hat stand 30 in the storage and transport configuration of the drum kit 1. Conversely, in the playing configuration of the drum kit 1, the inner volume defined by the panels of the parts 11 and 12 in the spaced-apart position is provided to be free, forming a bass drum resonance volume, referenced V10 in FIG. 6: it will be understood that this bass drum resonance volume V10 is defined, at the front, by the panel 13, which thus forms a striking panel, and at the rear, by the panel 18, which forms an output panel for the sound via its opening 18A.

In order to keep the parts 11 and 12 of the bass drum 10 in position relative to one another in each of the spaced-apart and compact positions, the parts 11 and 12 are provided with ad hoc means making it possible to assemble these parts to one another securely, selectively in the spaced-apart position and the compact position. As an example implemented in the figures, these assembly means comprise two tappings 111, respectively provided in the side panels 19 of the part 12, and two butterfly screws 112, complementary to the tappings 111. Each butterfly screw 112 is able to be inserted through the through holes 113 defined by the side walls 14 of the part 11: each panel 14 is provided with two of these through holes 113, arranged so as to be aligned with the tappings 111 of the panel opposite 19 in the spaced-apart position and the compact position, respectively, as shown by comparing FIGS. 3 and 11. Of course, other embodiments of these assembly means can be considered, in particular able to be actuated without tools.

The panels 13, 14, 18 and 19 are advantageously made from wood, in particular multilayer wood, particularly with a base of poplar and such as plywood. In order to benefit from a high sound quality, the front panel 13 includes both in the front, a striking plate 13.1, which is thinner than the other panels of the bass drum 10 and the front face of which is made from Tanganyika walnut, and in at the rear, a frame 13.2, which borders the periphery of the rear face of the striking plate 13.1 and to which the side panels 14 are secured, as clearly shown in FIG. 2.

Figure 5:
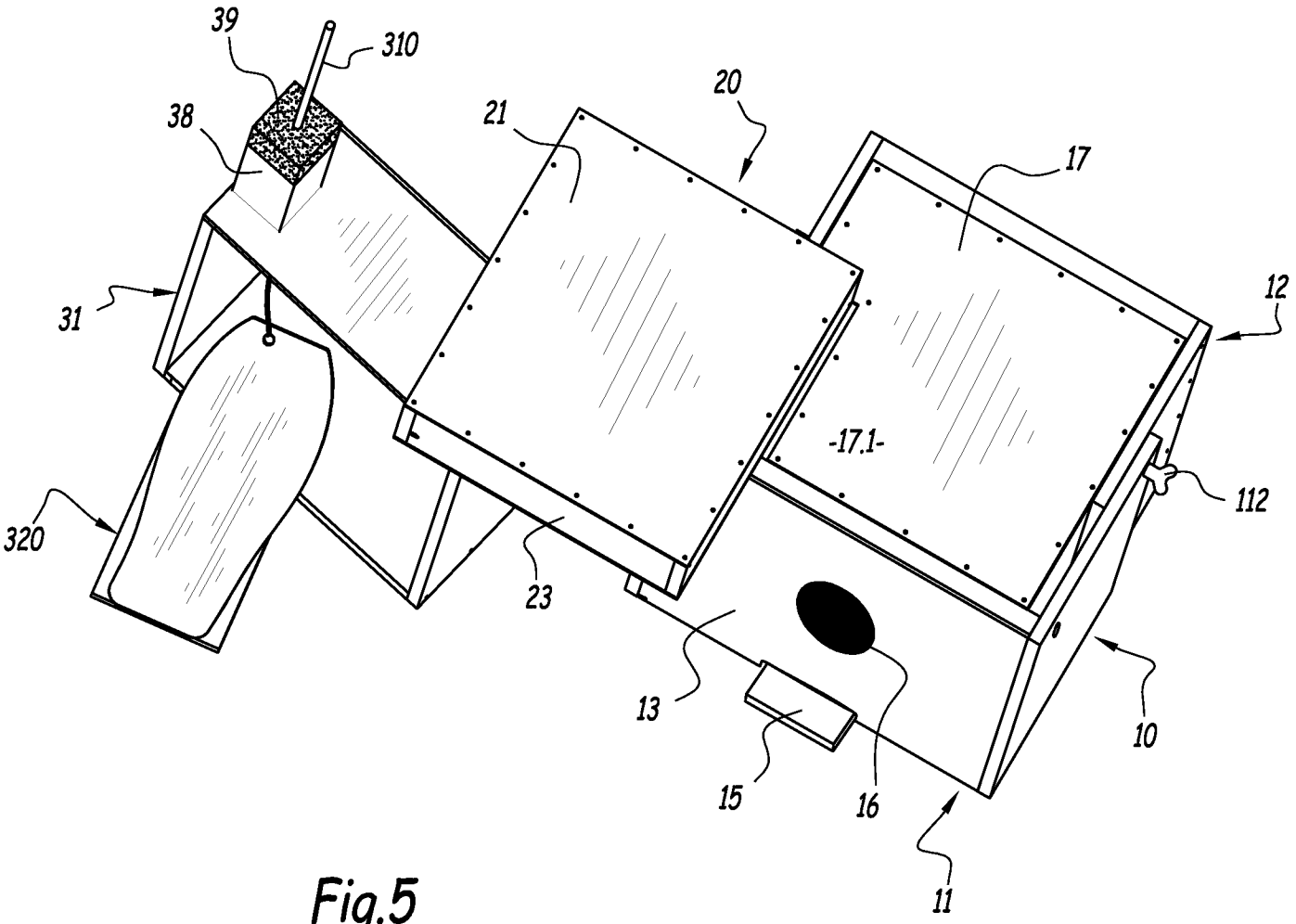
Figure 6:
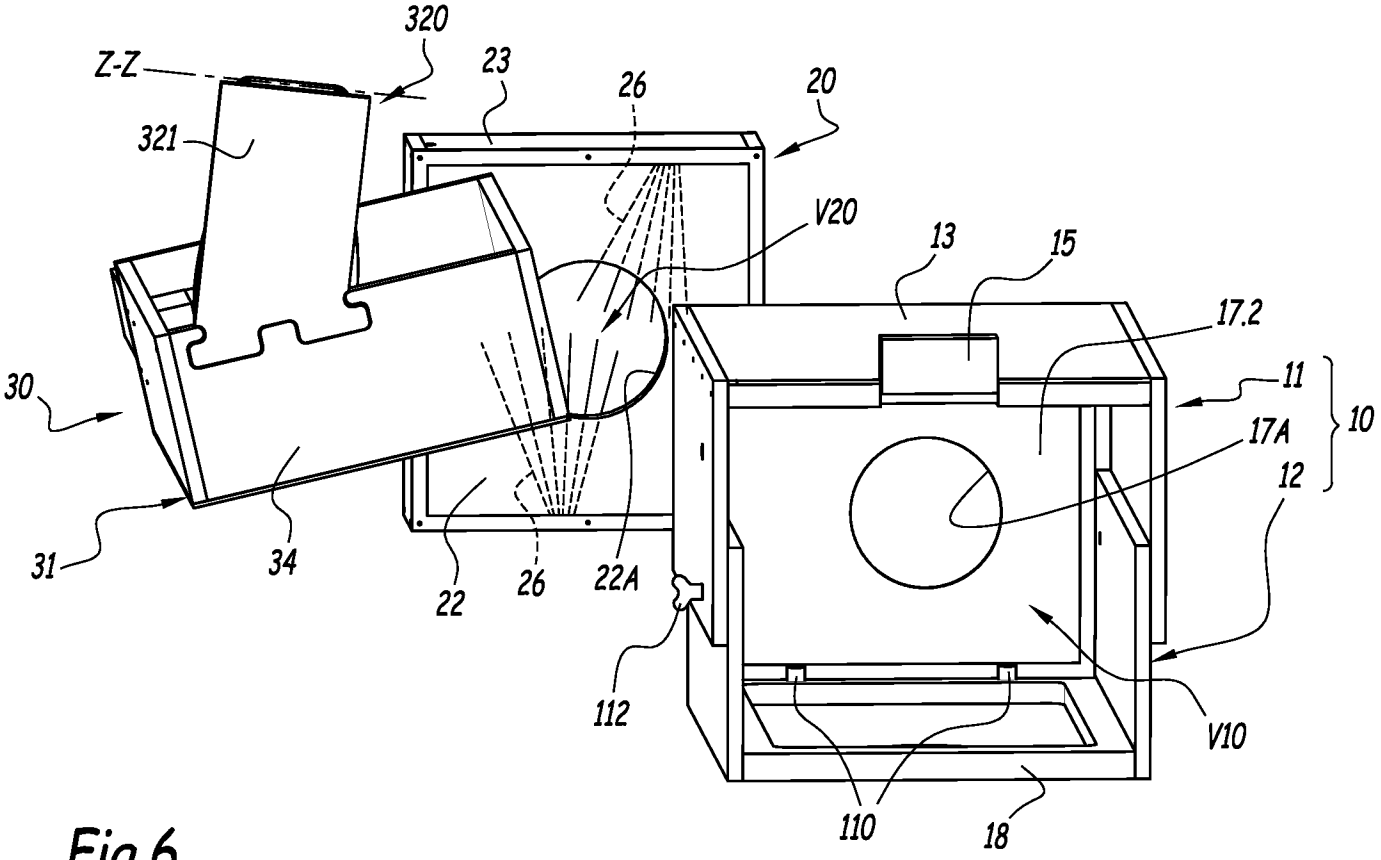
Figure 7:
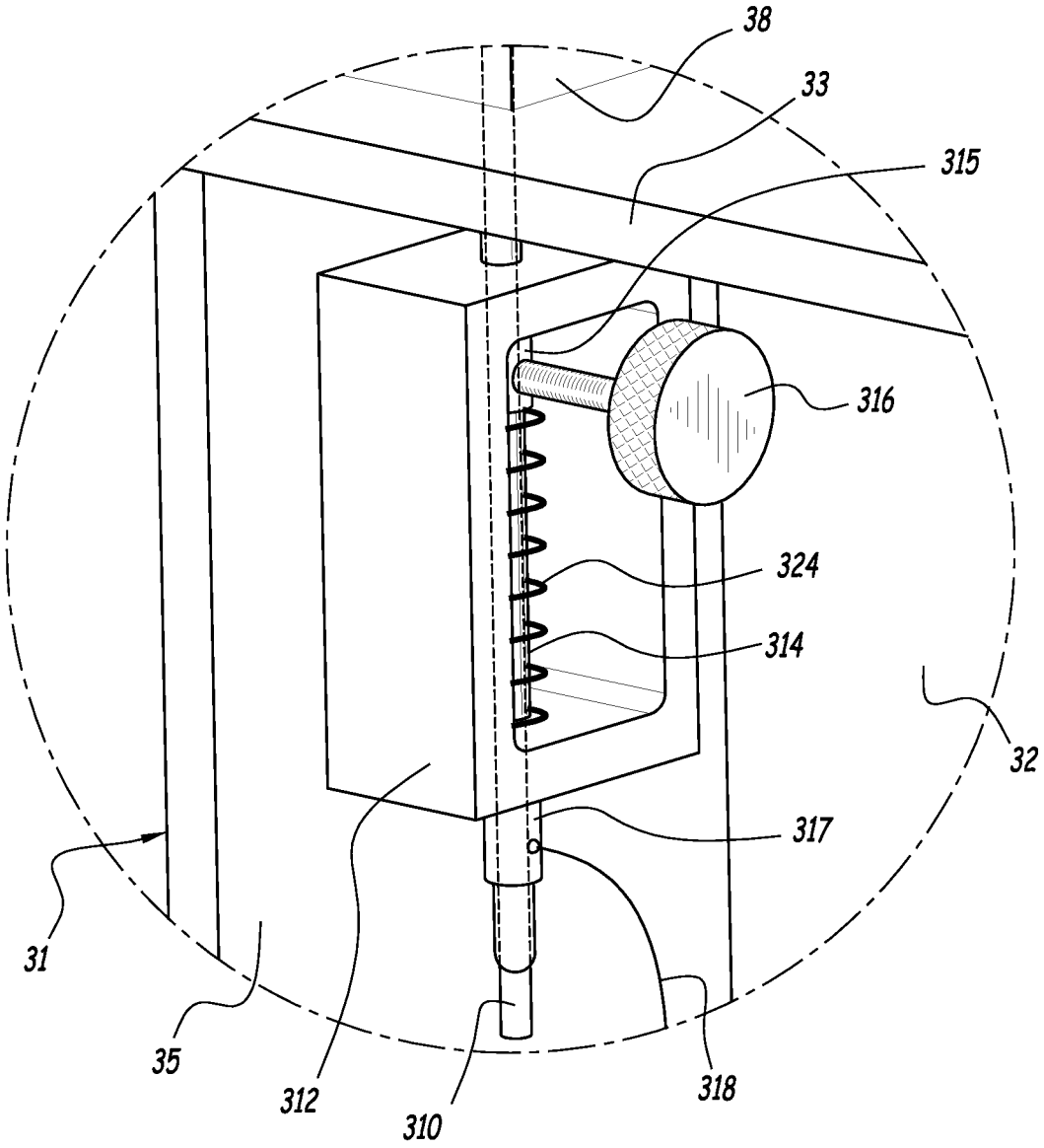
FIG. 7 is an enlarged view of the circled detail VII of FIG. 4.

As indicated above, the panel 17 is mounted tilting relative to the panel 13 of the front part 11, around the axis Y-Y. This panel 17 can thus be tilted between a service position, shown in FIGS. 3-6, and a storage position, shown in FIGS. 9-11 and shown in solid lines in FIG. 2. The panel 17 shown in dotted lines in FIG. 2 occupies an intermediate tilted position between the service position and the storage position. In the service position, the panel 17 extends horizontally, in other words perpendicular to the front panel 13, while thus being deployed relative to the latter, whereas, in the storage position, the panel 17 extends vertically and is retracted, while being pressed against the rear face of the front panel 13. Under the effect of gravity, the panel 17 tends to occupy the storage position, the lifting of the panel from the storage position to the service position being done manually by the user during the assembly of the drum kit 1. When the parts 11 and 12 of the bass drum 10 are in the spaced-apart position, the panel 17 is kept in its service position by cooperation with the rear part 12: in the example embodiment considered in the figures, the panel 17 is thus maintained in its service position by gravitational bearing of its free end on the protruding lugs 110 from the front face of the rear panel 18 of the part 12, as shown in FIG. 6, the panel 17 being dimensioned to nest between the side panels 19, as shown in FIG. 5. Thus, one will understand that the panel 17 in the service position closes the upper side of the bass drum resonance volume V10.

The panel 17 is advantageously made from wood, in particular multilayer wood, such as plywood. This panel 17 can be provided to be solid or, according to one particularly advantageous embodiment, which is also implemented in the example considered in the figures, the panel 17 includes, on its side turned upward in the service position, a striking plate 17.1, which is thinner than the rest of the panel 17 and whereof the face turned upward is made from Tanganyika walnut. The panel 17 then also includes, on its side opposite the striking plate 17.1, a sound outlet plate 17.2 defining a through opening 17A, visible in FIG. 6. This opening 17A emerges downward in the bass drum resonance volume V10 when the panel is in the service position, and it emerges upward in a free volume defined by the panel 17 between its plates 17.1 and 17.2, for example in the thickness of the plate 17.2. This free volume constitutes a tom-tom resonance volume inasmuch as, in the playing configuration of the drum kit 1, the drummer obtains a tom-tom sound by striking, using the drumsticks or brushes, the plate 17.1 of the panel 17 in the service position. More generally, it will be understood that in a way, the drum kit 1 thus includes an additional percussion instrument, i.e., a tom-tom, without increasing the overall bulk of the drum kit due to the integration of this tom-tom into the bass drum 10, more specifically the part 11 thereof, in the form of the panel 17.

The snare drum 20 comprises two parallel main panels, i.e., an upper panel 21 and a lower panel 22. The respective peripheries of the upper 21 and lower 22 panels are connected to one another by a front panel 23, a rear panel 24 and side panels 25, left and right, respectively. The panels 21-25 are substantially planar and are fixedly permanently secured to one another, using any appropriate means.

As shown in FIGS. 1-6, the panels 21-25 give the snare drum 20 a globally parallelepiped outer shape. According to one preferred dimensioning, this parallelepiped outer shape measures 23.3 cm×25.5 cm×9.7 cm.

The panels 21-25 jointly define an inner volume between them, substantially parallelepiped, of the snare drum 20, making up a free snare drum resonance volume V20. This snare drum resonance volume V20 is upwardly defined by the upper panel 21, which thus forms a striking panel on the upper face of which the drummer strikes the drumsticks or brushes in the playing configuration of the drum kit 1. In order for the sound produced in the resonance volume V20 to be characteristic of that of a snare drum, the upper panel 21 is, on its lower face, provided with snares 26 that vibrate when the upper face of the panel 21 is struck. In the example embodiment considered in the figures, two snares 26 are provided, in the form of two groups of metal wires, one of the ends of which is respectively fastened to the side panels 25. The snare drum resonance volume V20 is downwardly defined by the lower panel 22, which forms a sound outlet panel via a through opening 22A defined by that panel 22.

The panels 21-25 are advantageously made from wood, in particular multilayer wood, particularly with a base of poplar and such as plywood. In order to obtain a good sound quality, the upper face of the panel 21 is made from Tanganyika walnut.

As shown in FIGS. 3-7, the snare drum 20 is fastened on the bass drum 10 in the playing configuration of the drum kit 1. More specifically, the lower panel 22 of the snare drum 20 is fastened to the panel 17, in the service position, of the bass drum 10, a right part of the lower face of this panel 22 resting on only part of the upper face of this panel 17. The panel 22 of the snare drum 20 and the panel 17 of the bass drum 10 are provided with corresponding attachments for removable fastening, able to keep the snare drum 20 in place on the bass drum 10 in the playing configuration of the drum kit 1 while the drummer plays the drum kit. In the example embodiment considered in the figures, these attachments for removable fastening comprise a magnetized pin 114, arranged securely protruding from the panel 17, in the zone of that panel to be covered by the snare drum 20, and a recess with a ferromagnetic bottom 27, complementary to the pin 114 and defined by the panel 22: in the playing configuration of the drum kit 1, the pin 114 is received in the recess 27 and is placed in contact with the bottom of that recess, thereby locking the snare drum 20 and the bass drum 10 in position relative to one another, both by shape matching between the pin 114 and the recess 27 and by magnetic locking between said pin and the bottom of this recess. Of course, other embodiments can be considered for the attachments between the snare drum 20 and the bass drum 10, as long as these attachments keep the snare drum and the bass drum in place in the playing configuration of the drum kit 1 while the drummer plays, while allowing, in particular without tools, the separation of the snare drum and the bass drum from one another in order to transition the drum kit from the playing configuration to the storage and transport configuration.

According to one advantageous arrangement, which is implemented in the example embodiment considered in the figures, two recesses 27 are provided, as clearly shown in FIG. 2: in this way, during the assembly of the bass drum 10 and the snare drum 20 to one another to place the drum kit 1 in its playing configuration, the user chooses, from among the two available recesses, the recess 27 actually receiving the pin 114, these two recesses thus respectively being associated with two different adjusting positions. This adjusting choice allows the user to best adapt the playing configuration of the drum kit 1 to his morphology or his playing preferences, related to the relative positioning of the bass drum 10 and the snare drum 20.

As clearly shown in FIGS. 3-7, the hi-hat stand 30 comprises a base 31 which, in the playing configuration of the drum kit 1, bears on the ground. This base 31 has a globally parallelepiped outer shape, while being closed on all of its sides, except its side facing forward. Thus, the base 31 comprises a rear main panel 32, an upper panel 33, a lower panel 34 and side panels 35, left and right, respectively, the panels 33, 34 and 35 extending forward from the peripheral perimeter of the rear panel 32, perpendicular thereto. Each of the panels 32 to 35 is substantially planar. The panels 32 to 35 are substantially fixedly permanently secured to one another. The inner volume of the base 31, which is defined jointly by the panels 32 to 35, is open on the outside of the base 31 by its front side.

In the playing configuration of the drum kit 1, the snare drum 20 is, in addition to being fastened removably on the bass drum 10 as previously explained, removably fastened on the base 31 of the hi-hat stand 30. More specifically, the lower panel 22 of the snare drum 20 is fastened on the upper panel 33 of the base 31, a left part of the lower face of the panel 22 bearing on the upper face of the panel 33, only partially covering that panel 33. To guarantee the horizontality of the snare drum 20 in the playing configuration of the drum kit 1, it is understood that the vertical dimension of the base 31 is equal to that of the bass drum 10, the upper panel 33 thus being aligned at the same height as the panel 17, in the service position, of the bass drum.

As clearly shown in FIGS. 3 to 6, in the playing configuration of the drum kit 1, the bass drum 10 and the base 31 of the hi-hat stand 30 are spaced apart from one another, along the horizontal, such that the snare drum 20 is cantilevered with respect both to the bass drum 10 and the base 31 of the hi-hat stand 30: in this way, the through opening 22A of the lower panel 22 of the snare drum 20 emerges outside the snare drum, in the free space arranged between the bass drum 10 and the base 31 of the hi-hat stand.

According to technical considerations similar to those developed above regarding the removable fastening between the snare drum 20 and the bass drum 10, the snare drum and the base 31 of the hi-hat stand 30 are provided with attachments for removable fastening making it possible to keep the snare drum 20 and the base 31 in place relative to one another in the playing configuration of the drum kit 1. In the example embodiment considered in the figures, the attachments comprise two magnetized pins 36, provided securely protruding from the upper panel 33 of the base 31, and two recesses with a magnetic bottom 28, respectively complementary to the pins 36 and defined in the lower panel 22 of the snare drum 20. In the playing configuration of the drum kit 1, the pins 36 are respectively received in the recesses 28 and are respectively placed in contact with the bottom of those recesses: the lower panel 22, and thus the snare drum 20, are then blocked bearing on the upper panel 33, and thus opposite the base 31 of the hi-hat stand 30, both by shape matching between the pins 36 and the recesses 28 and by magnetic locking between said pins and the ferromagnetic bottom of the recesses. Of course, as mentioned above for the pin 114 and the recess 27, embodiments other than the pins 36 and recesses 28 can be considered for the attachments between the snare drum 20 and the base 31 of the hi-hat stand 30.

Owing to the attachments between the snare drum 20 and, on the one hand, the bass drum 10, and on the other hand, the hi-hat stand 30, it is understood that the snare drum 20 forms a connecting and relative positioning bridge between the bass drum 10 and the hi-hat stand 30 in the playing configuration of the drum kit 1.

Furthermore, the base 31, due to its outside dimensioning, is designed to be housed inside the bass drum 10, between the parts 11 and 12 of the latter in the compact position. More specifically, as shown in FIGS. 10 and 11, the base 31 can be nested completely inside the rear part 12 of the bass drum 10: the side panels 35 of the base 31 are received in an adjusted manner between the side panels 19 of the rear part 12, the rear panel 18 of the part 12 closing the front side of the base 31 in the storage and transport configuration of the drum kit 1.

Figure 8:
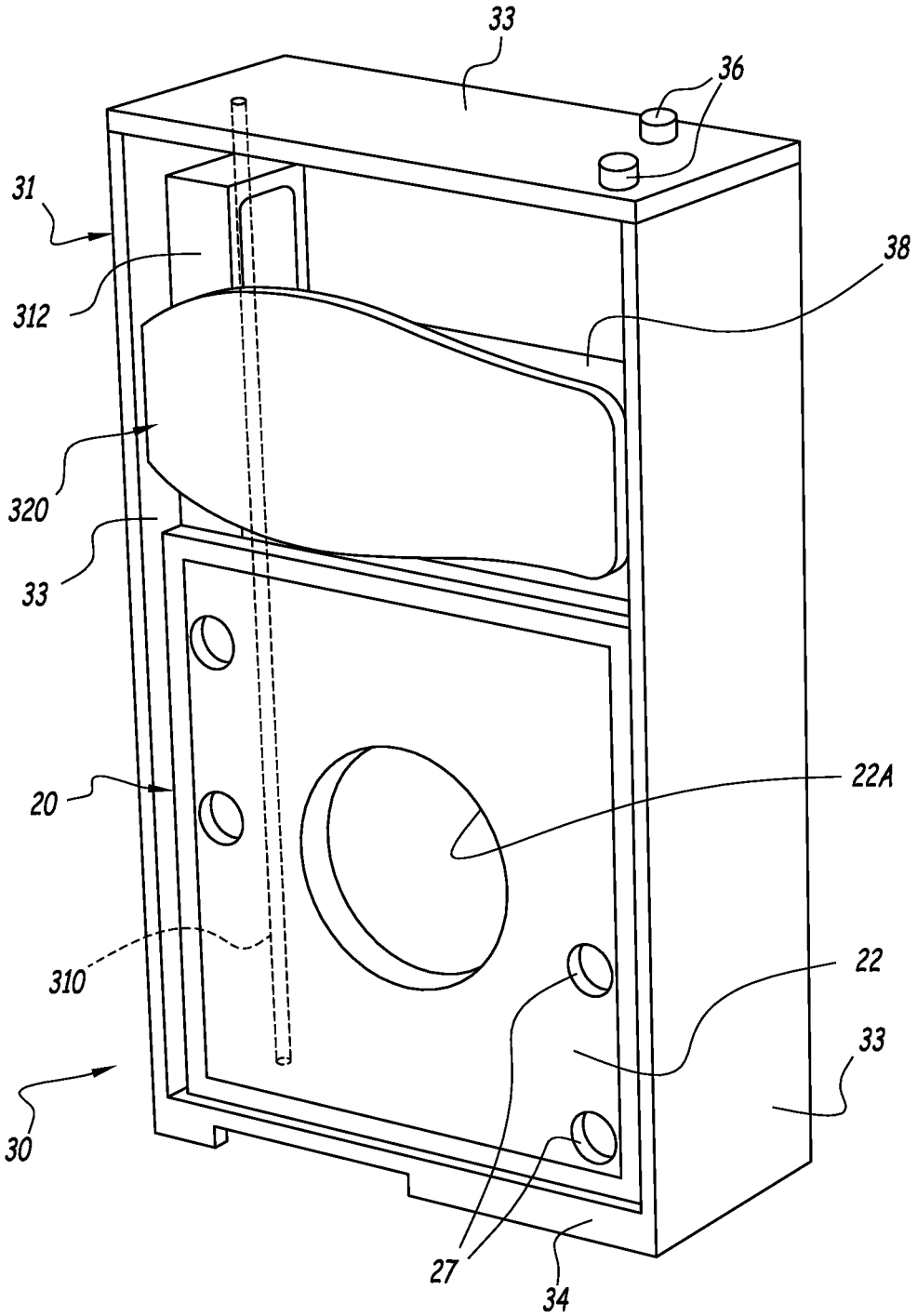
FIGS. 8-11 are perspective views, from different respective viewing angles, showing the gradual transition of the drum kit of FIG. 1 from its playing configuration, shown in FIGS. 3-6, to a storage and transport configuration, shown in FIG. 11.

Inwardly, the base 31 of the hi-hat stand 30 is dimensioned to completely receive the snare drum 20 in the storage and transport configuration of the drum kit 1, as shown in FIG. 8. More specifically, the snare drum 20 is nested completely inside the base 31: the side panels 25 of the snare drum being received in an adjusted manner between the side panels 35 of the base 31.

The hi-hat stand 30 also includes a spacer 38 that is separate from the base 31. In the playing configuration of the drum kit 1, the spacer 38 is inserted vertically between the base 31 and the lower cymbal 3 of a pair of hi-hat cymbals 2, shown in dotted lines only in FIG. 4. In the considered example embodiment, the spacer 38 assumes the form of a vertically elongated block. In the playing configuration of the drum kit 1, the lower end of the spacer 38 rests on the upper panel 33 of the base 31 of the hi-hat stand 30. The upper end of the spacer 38 forms a downward support for the lower cymbal 3: advantageously, this upper end of the spacer 38 is provided with a nonslip pad 39 favoring the maintenance in place of the cymbal 3.

Figure 9:
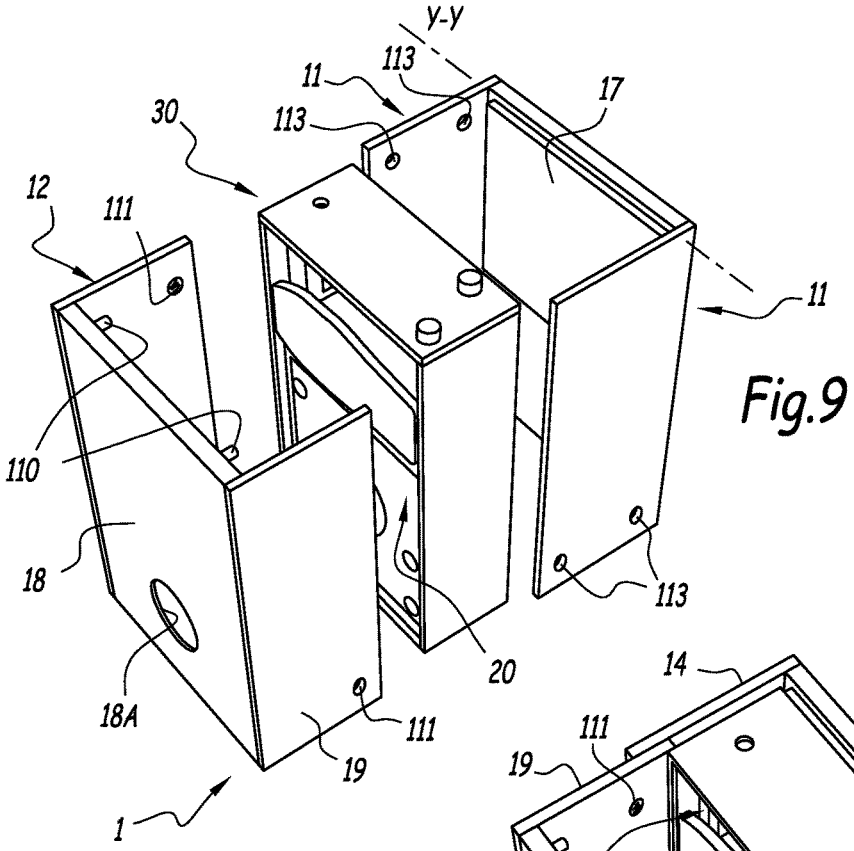

The spacer 38 is dimensioned so as, in the storage and transport configuration of the drum kit 1, to be housed completely inside the base 31 of the hi-hat stand 30, jointly with the snare drum 20, as shown in FIGS. 8 and 9. In the example embodiment considered here, the spacer 38 has a vertical dimension strictly smaller than the horizontal separation between the faces, opposite one another, of the side panels 35 of the base 31, thereby making it possible to arrange the spacer 38 substantially at the horizontal between the side panels 35 of the base 31 in the storage and transport configuration of the drum kit 1.

The hi-hat stand 30 also includes a control rod 310 for the upper cymbal 4 of the pair of hi-hat cymbals 2. This rod 310, which is separate from the base 31 and the spacer 38, is supported by the base 31 translatably in the longitudinal direction of that rod, the latter extending vertically in the playing configuration of the drum kit 1. The rod 310 is thus translatable relative to the base 31 between a deployed position, associated with the playing configuration of the drum kit 1, and a retracted position, associated with the storage and transport configuration. In its deployed position, the rod 310 extends mainly outside the base 31, traversing the upper panel 33 of that base, as well as the spacer 38, between the lower and upper ends of that spacer, until it emerges from the upper end of the spacer, as clearly shown in FIGS. 3-5. Thus, in the deployed position of the rod 310, this rod freely traverses the lower cymbal 3, which is open-worked to that end, and the upper cymbal 4 can be fastened to the upper end of the rod 310, using any appropriate means, having also noted that the pair of cymbals 2 is known in itself and commercially available as an accessory for the acoustic drum kits of the prior art. In its retracted position, the rod 310 does not extend outside the base 31, but is completely housed inside that base, as indicated in dotted lines in FIG. 8. In practice, it will be understood that the longitudinal dimension of the rod 310 is equal to or smaller than the vertical dimension of the base 31.

So as not to block the retraction of the rod 310 inside the base 31 when the snare drum 20 is housed therein, the snare drum defines, in its front panel 23, a through hole 29, arranged so as to receive the rod 31 through it in the retracted position. Advantageously, the through hole 29 is substantially complementary to the rod 310 such that, in the retracted position, the rod 310 keeps the snare drum 20 in place inside the base 31 in the storage and transport configuration of the drum kit 1.

In the deployed position, it is provided that the rod 310 retains a translational mobility in its longitudinal direction, relative to the base 31, so as to translate the upper cymbal 4 of the pair of hi-hat cymbals 2 accordingly in the playing configuration of the drum kit 1. This translatable connection between the base 31 and the rod 310 in the deployed position is done at a housing 312, shown in detail in FIG. 7 and securely integrated inside the base 31, immediately below the zone of the upper panel 33, traversed by the rod 310. In the example embodiment, this housing 312 is fastened to one of the side panels 35 of the base 31. The housing 312 is provided with a vertical tube 314 mounted sliding through the housing 312 along the longitudinal direction of that tube. In its upper part, the tube 314 is securely provided with an outer ring 315 transversely traversed by a knurled screw 316 engaged as far as the inside of the tube 314. The rod 310 is mounted sliding, along its longitudinal direction, inside the tube 314: subject to tightening of the screw 316, it is understood that the rod 310 is securely connected to the tube 314, both when the rod is in the deployed position and when it is in the retracted position, while, when the screw 316 is unscrewed, the rod 310 is freely translatable inside the tube 314, allowing it to pass between the deployed and retracted positions.

At its lower end, which emerges from the lower end of the housing 312, the tube 314 is securely provided with an outer ring 317 secured to a traction rope 318: it is understood that by pulling the rope 318 downward, the tube 314 is translated downward relative to the housing 312, and thus relative to the base 31 of the hi-hat stand 30. The end of the cable 318, opposite that secured to the ring 317, is secured to a pedal 320 belonging to the hi-hat stand 30. This pedal 320 comprises a lower panel 321 and an upper panel 322, articulated on one another around a hinge pin Z-Z, for example via a hinge. The upper panel 322 is, at its end opposite the hinge pin Z-Z, secured to the traction rope 318, using any appropriate means. The panel 321 is, at its end opposite the hinge pin Z-Z, designed to be removably fastened to the base 31: more specifically, in the example embodiment considered in the figures, this end of the lower panel 321 has an embedding contour with a complementary cavity, defined in the lower face of the lower panel 34 of the base 31, such that, in the playing configuration of the drum kit 1, this end of the lower panel 321 of the pedal 320 is blocked by the base 31, cooperating exclusively by shape matching with the lower panel 34 of that base, as clearly shown in FIG. 6. Of course, other embodiments are possible for the removable connection between the pedal 320 and the base 31.

In the playing configuration of the drum kit 1, it will be understood that by stressing the pedal 320 using his left foot, by pressing on the panel 322 so as to bring it closer to the panel 321, the drummer pulls the traction cord 318 downward, and thus the tube 314 and therefore the rod 310 when the latter is securely connected to the tube by the tightened screw 316. In other words, the pedal 320 makes it possible, in the playing configuration of the drum kit 1, to translate the rod 310 relative to the base 31 of the hi-hat stand 30 when that rod is in the deployed position, carrying out corresponding driving of the upper cymbal 4 fastened to the upper end of that rod.

In order to return the rod 310 upward when the drummer releases his pressure on the pedal 320, the hi-hat stand 30 comprises a spring 324 arranged permanently inside the housing 312. More specifically, in the considered example embodiment, the spring 324 is arranged around the tube 314, more specifically around the running part of the latter. As clearly shown in FIG. 7, the upper end of the spring 324 is pressed upward against the ring 315, while its lower end is pressed against the housing 312, more specifically against the lower wall of the housing, traversed slidingly by the tube 314. It will be understood that when the tube 314 is moved downward, its ring 315 compresses the spring 324, which then tends to push the tube upward again. To guarantee operation without jolts, the spring 324 is advantageously arranged in the housing 312 in a compressed state, inasmuch as, even without pulling of the tube 314 downward, the spring 324 presses the ring 315 against the housing 312, more specifically against the upper wall thereof, traversed slidingly by the tube 314. Thus, in the playing configuration of the drum kit 1, when the drummer presses on the pedal 320, the spring 324 elastically opposes the downward translation of the rod 310, while without stressing of the pedal 320, the spring 324 keeps the rod 310 in place, if applicable after having translated it upward again. It will be understood that the system associating the housing 312, the tube 314, the traction cord 318, the pedal 320 and the spring 324 allows the drummer to control the translation in both directions of the rod 310 in the longitudinal direction of that rod, and in this way, to control the approach-separation of the upper cymbal 4 with respect to the lower cymbal 3 of the pair of hi-hat cymbals 2.

In the storage and transport configuration of the drum kit 1, the pedal 320 is housed completely inside the base 31 of the hi-hat stand 30, as shown in FIGS. 8-10. In practice, the pedal 320 occupies the part of the inner volume of the base 31 left free by the snare drum 20 and the spacer 38 that are also housed in the inner volume. Thus, the snare drum 20 preferably occupies the lower part of the inner volume of the base 31, taking advantage of the entire horizontal separation between the side panels 35, without interfering with the housing 312, while the spacer 38 and the pedal 320, as well as the traction cord 318, occupy the upper part of the inner volume of the base 31, resting on the front panel 23 of the snare drum 20 and accommodating the presence of the housing 312, subject to appropriate dimensioning of these parts.

The panels 32 to 35 of the base 31 and the panels 321 and 322 of the pedal 320 are advantageously made from wood, in particular multilayer wood, such as plywood. The spacer 38 and the housing 312 are advantageously made from solid wood, for example beech. Alternatively, inasmuch as the elements of the hi-hat stand 30 do not need to be struck or resonated, all or part of the base 31, the pedal 320, the spacer 38 and/or the housing 312 can be made from materials other than wood, in particular metal or a synthetic material, such as a plastic material. The rod 310, the tube 314, the traction cord 318 and the spring 324 are preferably made from metal.

Taking into account all of the preceding explanations, it will be understood that, to transition the drum kit 1 from its playing configuration to its storage and transport configuration, the drummer releases both the pair of cymbals 2 and the bass drum pedal mentioned above, then disassembles the snare drum 20 from the base 31 of the hi-hat stand 30 and with respect to the bass drum 10, advantageously without tools, by pulling the snare drum upward until the cooperation between the pins 114 and 36 and the recesses 27 and 28 is neutralized. The drummer next disassembles the components of the hi-hat stand 30: without tools, he disassembles the pedal 320 from the lower panel 34 of the base 31 and disassembles the spacer 38 with respect to the upper panel 33 of the base 31, causing it to rise along the rod 310, for the moment kept in the deployed position, until the spacer is freed from the rod. The drummer places the snare drum 20 in the lower part of the inner volume of the base 31, steering the panel 23 upward: he can then loosen the screw 316 and push the rod 310 downward, so as to transition it from its deployed position to its retracted position, passing through the hole 29 of the snare drum 20, the latter thus being blocked inside the base 31 by the rod 310. The spacer 38 and the pedal 320 are next placed in the upper part of the inner volume of the base 31, as shown in FIG. 8. At this stage, the hi-hat stand 30 and the snare drum 20 appear as shown in FIG. 8 and are next, as a whole, housed inside the bass drum 10. The parts 11 and 12 of the bass drum 10 have been separated from one another beforehand, subject to the removal of the butterfly screws 112: the panel 17 then switches from its service position to its storage position, as shown in FIG. 9. By nesting the base 31 in the part 12 and by nesting the part 12 in the part 11, as shown in FIG. 10, the drum kit 1 reaches the storage and transport configuration of FIG. 11, the parts 11 and 12 next being able to be assembled to one another by the butterfly screws 112. The panel 17 being in its storage position, it does not interfere with the base 30, thus allowing the complete nesting of that base between the parts 11 and 12 of the bass drum 10.

The passage of the drum kit 1 from its storage and transport configuration to its playing configuration is done through operations opposite those described above. In both cases, these operations are done, in total, in several tens of seconds, typically less than one minute, for example about 40 seconds.

It will be noted that particularly advantageously, the bass drum 10, the snare drum 20 and the hi-hat stand 30 jointly weigh less than 10 kg, or even less than 9 kg, or even less than 8 kg, or even less than 7 kg, or even less than 6 kg, or even weigh 5.7 kg. Such a weight complies with major airline requirements for authorized carry-on luggage.

In its playing configuration, the drum kit 1 produces a sound perfectly replacing that of an acoustic drum kit of the prior art. If applicable, this sound can be amplified by microphones commercially available as accessories for the acoustic drum kits of the prior art. It will be noted that the drum kit 1 is, due to its structure, advantageously predisposed to amplification with microphones pre-incorporated into that drum kit.

Lastly, various arrangements and alternatives to the drum kit 1 described thus far may be considered. As examples:

the various striking surfaces of the drum kit may be varnished, for example with liquid wax finish; the sound is not altered as a result, while forming a glazing necessary for sliding of the brushes, particularly used in swing and jazz music; and/or to prevent the drum kit 1 in the playing configuration from moving due to vibrations created during playing, the drum kit can be positioned on a nonslip mat, advantageously provided with the drum kit, folded up inside the bass drum 10 in the storage and transport configuration of the drum kit; if applicable, the lower faces and/or lower edges of the bass drum 10 and/or the base 31 and/or the pedal 320 are equipped with elements for attaching to the aforementioned mat, such as Velcro (registered trademark) strips; and/or bells, or more generally, instrumental percussion accessories, can be added to the drum kit, supported during use by the bass drum 10, the snare drum 20 and/or the hi-hat stand; and/or the indications of the dimensions and weights provided above are not limiting with respect to the invention; in particular, if transport as airplane carry-on luggage is abandoned, the drum kit 1 may be dimensioned to be larger, while retaining its reduced storage practicality and its ease of transport, for example in the trunk of a car; and/or the geometric shapes described above for the bass drum 10, the [snare] drum 20 and the hi-hat stand 30 are also not limiting with respect to the invention, inasmuch as these shapes may in practice have essentially aesthetic arrangements, such as rounded corners, chamfered angles, etc.

The invention claimed is:

1. An acoustic drum kit (1), comprising a bass drum, a snare drum and a hi-hat stand, wherein the snare drum has a globally parallelepiped outer shape, wherein the hi-hat stand includes a base having a globally parallelepiped outer shape, wherein the bass drum includes two parts that are movable with respect to one another between:

a spaced-apart position, in which the two parts of the bass drum jointly give the bass drum a globally parallelepiped outer shape and jointly define between them a free bass drum resonance volume that is substantially parallelepiped, and in which the snare drum is removably fastened to the base drum and to the base of the hi-hat stand such that the acoustic drum kit is in a playing configuration, and a compact position, in which the two parts of the bass drum jointly give the bass drum a globally parallelepiped outer shape and jointly define between them a housing volume which is substantially parallelepiped, which is smaller than the bass drum resonance volume and which is occupied by the hi-hat stand and the snare drum that is housed inside the base of the hi-hat stand, such that the acoustic drum kit is in a storage and transport configuration, wherein the bass drum and the snare drum are provided with first attachments suitable for removably fastening the snare drum on the bass drum in the playing configuration of the acoustic drum kit, and wherein the base of the hi-hat stand and the snare drum are provided with second attachments, which are separate from the first attachments and which are suitable for removably fastening the snare drum on the base of the hi-hat stand in the playing configuration of the acoustic drum kit.

2. The acoustic drum kit according to claim 1, wherein the two parts of the bass drum consist of a female part and a male part that can be nested inside the female part, the male part being only partially nested inside the female part in the spaced-apart position and the male part being more, nested inside the female part in the compact position.

3. The acoustic drum kit according to claim 1, wherein the globally parallelepiped outer shape of the bass drum in the compact position has dimensions of 30 cm×45 cm×18 cm.

4. The acoustic drum kit according to claim 1, wherein one of the two parts of the bass drum comprises a striking panel, and wherein the other of the two parts of the bass drum comprises a sound outlet panel provided with a through opening.

5. The acoustic drum kit according to claim 1, wherein one of the two parts of the bass drum is provided with a moving panel movable, relative to the rest of this part of the bass drum, between a service position, which the moving panel occupies when the two parts of the bass drum are in the spaced-apart position and in which the moving panel is deployed, while being maintained by cooperation with the other of the two parts of the bass drum, to fasten the snare drum there in the playing configuration of the acoustic drum kit, and a storage position, which the moving panel occupies when the two parts of the bass drum are in the compact position and in which the moving panel is retracted so as not to interfere with the snare drum and the hi-hat stand in the storage and transport configuration of the acoustic drum kit.

6. The acoustic drum kit according to claim 1, wherein the acoustic drum kit further includes a tom-tom integrated into one of the two parts of the bass drum.

7. The acoustic drum kit according to claim 6, wherein one of the two parts of the bass drum is provided with a moving panel movable, relative to the rest of this part of the bass drum, between a service position, which the moving panel occupies when the two parts of the bass drum are in the spaced-apart position and in which the moving panel is deployed, while being maintained by cooperation with the other of the two parts of the bass drum, to fasten the snare drum there in the playing configuration of the acoustic drum kit, and a storage position, which the moving panel occupies when the two parts of the bass drum are in the compact position and in which the moving panel is retracted so as not to interfere with the snare drum and the hi-hat stand in the storage and transport configuration of the acoustic drum kit, and wherein the moving panel forms the tom-tom, including a striking plate and a sound outlet plate provided with a through opening, which define a free tom-tom resonance volume between them.

8. The acoustic drum kit according to claim 1, wherein the snare drum comprises a sound outlet panel, provided with a through opening, and a striking panel provided, on its face turned toward the striking panel, with at least one snare, the sound outlet panel and the striking panel defining a snare drum free resonance volume between them.

9. The acoustic drum kit according to claim 1, wherein the first attachments are suitable for fastening the snare drum on the bass drum in at least two different adjusting positions.

10. The acoustic drum kit according to claim 1, wherein the base of the hi-hat stand is nestable between the parts of the bass drum in the compact position, and the snare drum is nestable inside the base in the storage and transport configuration of the acoustic drum kit.

11. The acoustic drum kit according to claim 1, wherein the hi-hat stand further includes a spacer, which is inserted between the base and a hi-hat cymbal in the playing configuration of the acoustic drum kit, and which is housed inside the base in the storage and transport configuration of the acoustic drum kit.

12. The acoustic drum kit according to claim 11, wherein the hi-hat stand includes a rod for controlling an upper hi-hat cymbal, which is translatable along its longitudinal direction relative to the base, between a deployed position, in which the rod extends to the outside of the base and through the spacer until it emerges from the end of the spacer, which is opposite the base, to fasten the upper hi-hat cymbal there in the playing configuration of the acoustic drum kit, and a retracted position in which the rod is housed inside the base in the storage and transport configuration of the acoustic drum kit.

13. The acoustic drum kit according to claim 12, wherein the hi-hat stand further includes a pedal, which is suitable, in the playing configuration of the acoustic drum kit, for translating the rod in the deployed position relative to the base, said rod being housed inside the base in the storage and transport configuration of the acoustic drum kit.

14. The acoustic drum kit according to claim 1, wherein the bass drum, the snare drum and the hi-hat stand jointly weigh less than 5.7 kg.

15. An ensemble of musical instruments, comprising:
an acoustic drum kit according to claim 1,
a bass drum pedal,
a pair of hi-hat cymbals, and
a pair of drumsticks or brushes.

* * * * *